US005575188A

United States Patent [19]

Hu

[11] Patent Number: 5,575,188

[45] Date of Patent: Nov. 19, 1996

[54] STRUCTURE OF CARD PUNCH

[75] Inventor: Chiang-Ho Hu, Taichung, Taiwan

[73] Assignee: Tah Hsin Industry Co., Ltd., Taichung, Taiwan

[21] Appl. No.: 369,890

[22] Filed: Jan. 9, 1995

[51] Int. Cl.[6] ..... B26F 1/14

[52] U.S. Cl. ..... 83/167; 83/549; 83/618; 83/629; 83/687; 412/16; 412/38

[58] Field of Search ..... 83/167, 549, 571, 83/629, 622, 618, 687; 402/1, 4; 412/16, 38

[56] References Cited

U.S. PATENT DOCUMENTS

| | | | |
|---|---|---|---|
| 1,049,676 | 1/1913 | Cousins et al. | 83/549 |
| 2,562,678 | 7/1951 | Okumura | 83/618 |
| 3,060,780 | 10/1962 | Stuckens | 83/618 |
| 4,077,288 | 3/1978 | Holland | 83/687 |
| 4,645,399 | 2/1987 | Scharer | 83/549 |
| 4,872,796 | 10/1989 | Hsieh et al. | 412/16 |
| 5,143,502 | 9/1992 | Kaufmann et al. | 83/549 |
| 5,163,350 | 11/1992 | Groswith, III et al. | 83/687 |
| 5,211,522 | 5/1993 | Ho | 412/16 |

*Primary Examiner*—Eugenia Jones
*Assistant Examiner*—Charles Goodman
*Attorney, Agent, or Firm*—Alfred Lei

[57] ABSTRACT

A card punch of the type having a rectangular hole punching unit driven by an operating handle through a transmission shaft to punch rectangular holes on loose leaves, the improvement comprising two driven gears meshed with two drive gears at two opposite ends of the transmission shaft, a sliding bar driven by the driven gears to force circular punching elements into holes on locating frames, which are fixed to a guide plate between two upright end plates of the base of the card punch, to punch holes on paper being inserted into the locating frames.

6 Claims, 8 Drawing Sheets

STRUCTURE OF CARD PUNCH

BACKGROUND OF THE INVENTION

The present invention relates to card punches, and relates more particularly to an improved structure of card punch which has a rectangular hole punching unit and a circular hole punching mechanism respectively operated by the same operating handle for punching rectangular holes or circular holes on paper.

Various card punches have been developed for punching holes on loose leaves, and have appeared on the market. FIGS. 6 and 7 show a rectangular hole card punch according to the prior art. This structure of card punch comprises a base 40, a punching and binding unit 41 raised from the base 40, a plurality of rectangular punching elements 42 driven by an operating handle 44 through a transmission mechanism (not shown) to punch paper, and a plurality of pull rods 43 respectively connected to the rectangular punching elements 42. By means of the pull rods 43, the rectangular punching elements 42 can be selectively moved out of the respective operating position so that the operating handle will not be able to drive the respective punch element(s) that are in the inoperative position. The punching and binding unit 41 further comprises a row of projecting rods 45, and a row of actuating rods 46 moved by the operating handle 44 relative to the projecting rods 45 for binding punched sheets of paper on the flat teeth 48 of a loose-leaf clip 47 (see FIG. 8). When the operating handle 44 is turned in one direction, the actuating rods 46 are moved forwards from the projecting rods 45 to open the loose-leaf clip 47 for permitting punched loose leaves to be loaded on the flat teeth 48 of the loose-leaf clip 47. When the operating handle 44 is turned in the reversed direction, the actuating rods 46 are moved backwards to the projecting rods 45 to close the loose-leaf clip 47, and therefore the punched loose leaves are fastened to the loose-leaf clip 47.

The aforesaid rectangular hole card punch is functional. However, this structure of rectangular hole card punch is applicable only for punching rectangular holes on paper. Loose leaves with rectangular binding holes cannot be firmly retained together by a loose-leaf clip with circular teeth. Therefore, when a loose-leaf clip with circular is used to fasten sheets of paper together, these sheets of paper must be punched by a card punch with circular punching elements. Regular card punches with circular punching keys are not adjustable. For punching different numbers of binding holes on paper, different card punches with different numbers of circular punching elements have to be separately used.

SUMMARY OF THE INVENTION

The present invention has been accomplished under the circumstances in view. It is therefore the principal object of the present invention to provide an improved structure of card punch which is applicable for punching circular holes as well as rectangular holes on paper. It is another object of the present invention to provide a multipurpose card punch which is simple in structure. According to the present invention, a circular hole punching mechanism is installed in a regular rectangular hole card punch, which is operated by an operating handle through a transmission shaft to drive rectangular punching elements into paper. The circular hole punching mechanism comprises two driven gears meshed with two drive gears at two opposite ends of the transmission shaft, a sliding bar driven by the driven gears to force circular punching elements into holes on locating frames, which are fixed to a guide plate between two upright end plates of the base of the card punch, to punch holes on paper being inserted into the locating frames.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
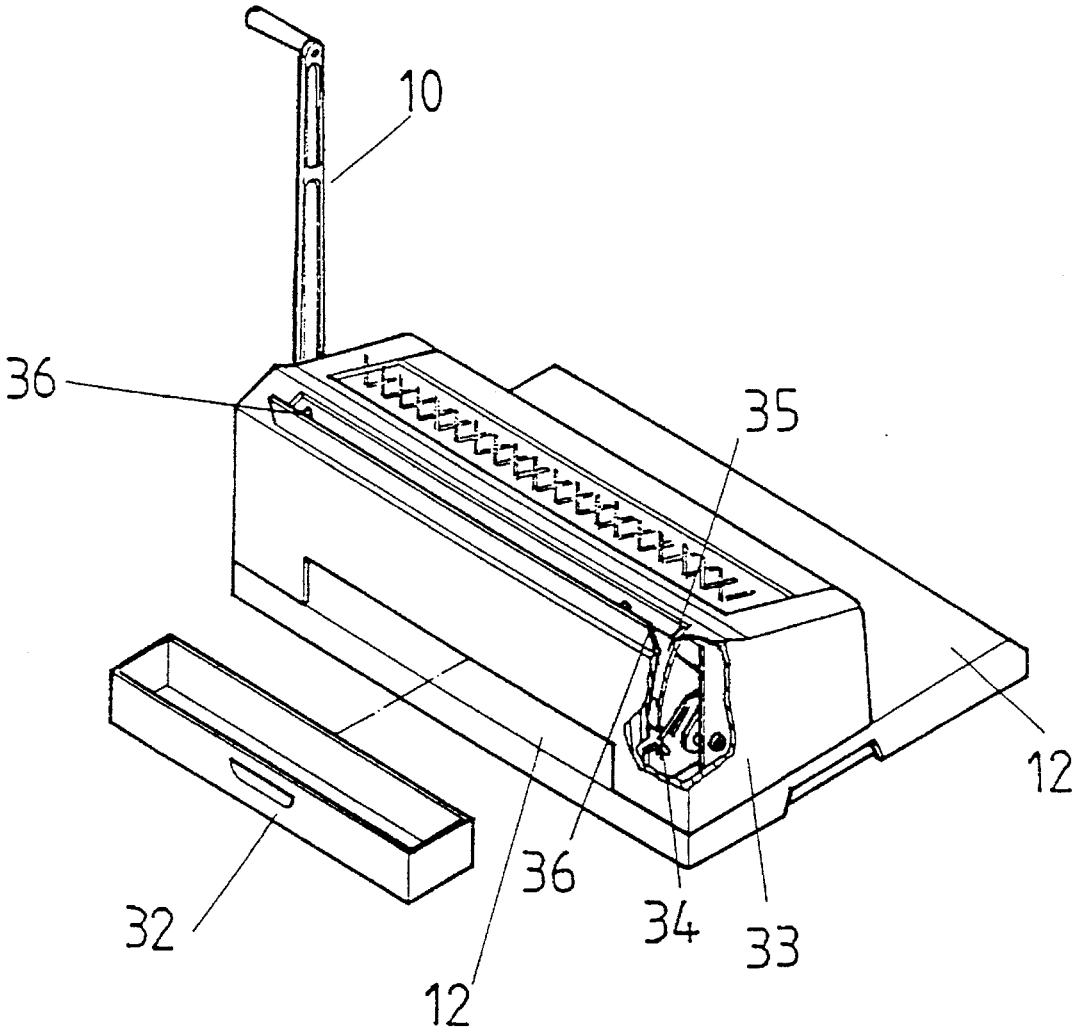
FIG. 1 is a cutaway of a card punch according to the present invention.
Figure 2:
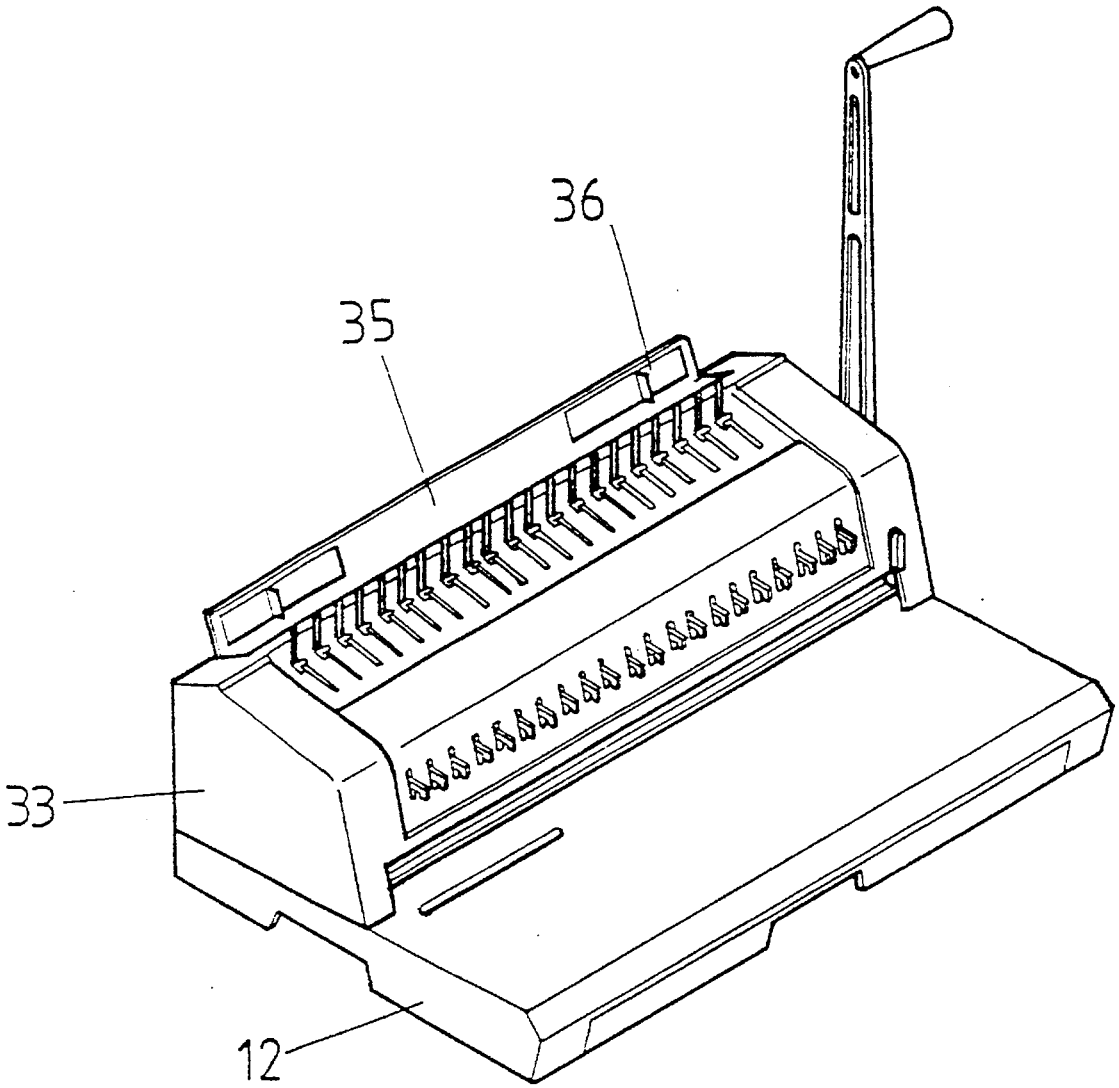
FIG. 2 is an elevational view of the card punch shown in FIG. 1.
Figure 3:
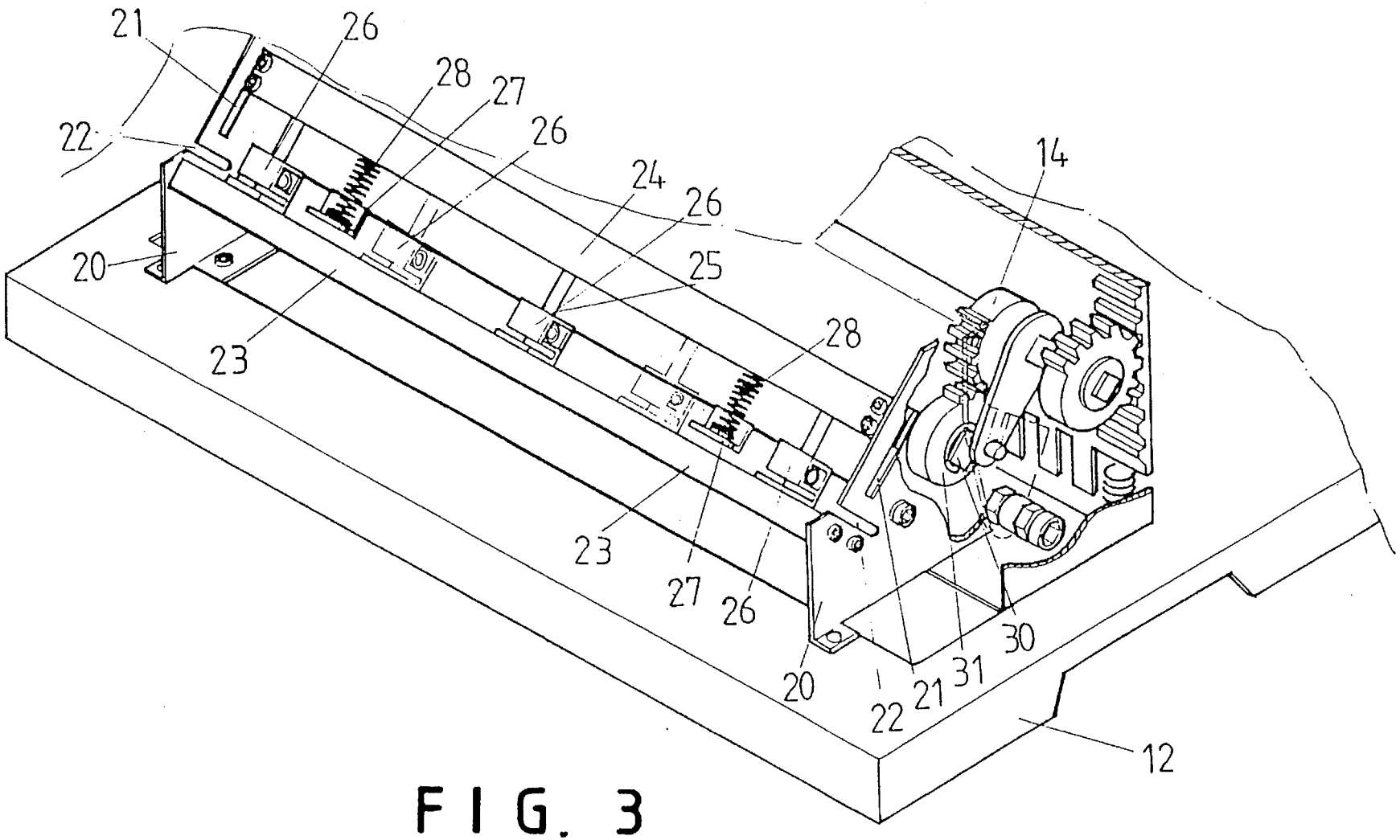
FIG. 3 is a perspective view of the rear part of the card punch shown in FIG. 1, showing the installation of the circular hole punching mechanism.
Figure 4:
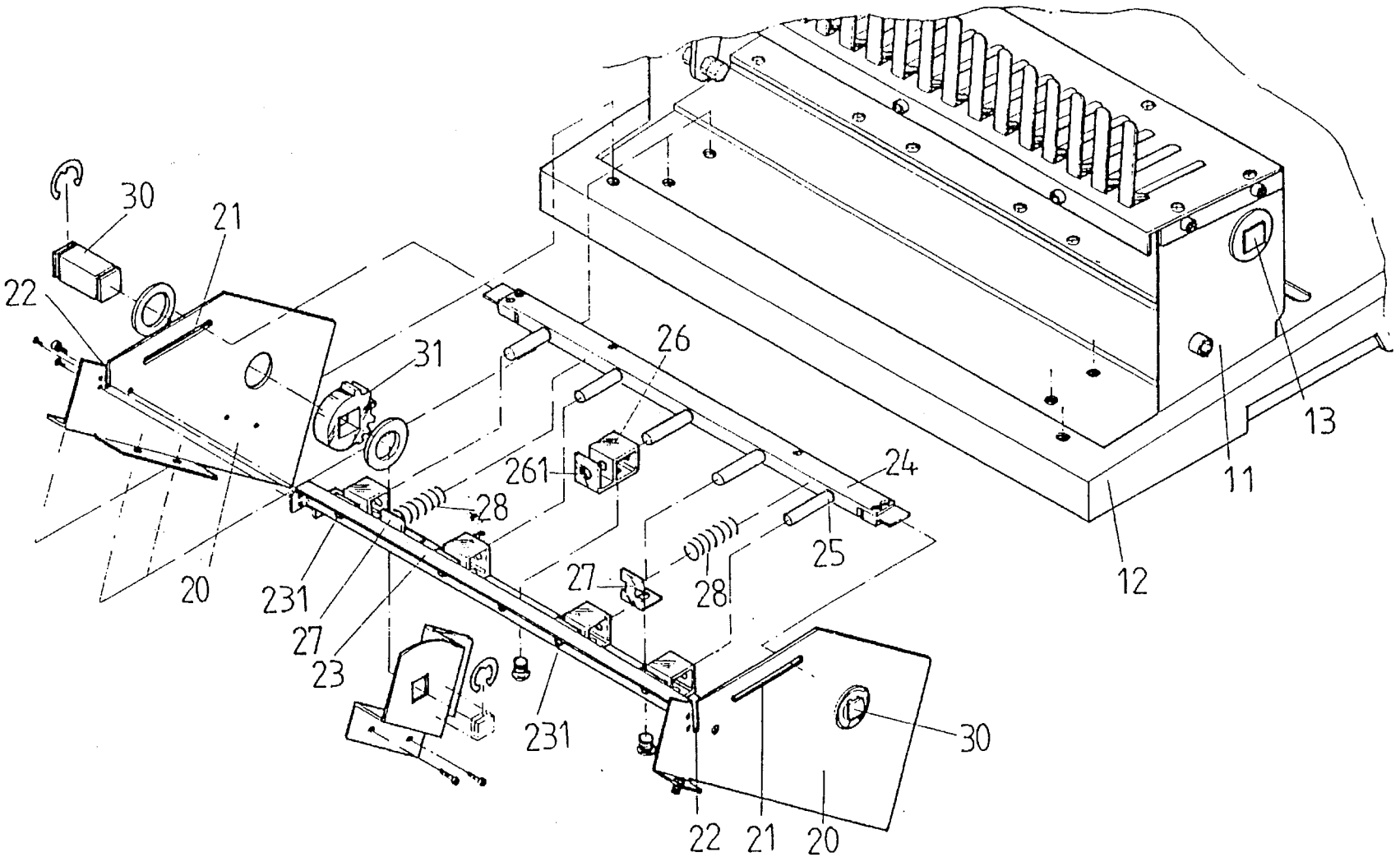
FIG. 4 is an exploded view of the circular hole punching mechanism shown in FIG. 3.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Referring to FIGS. 1, 2, 3, and 4, two upright end plates 20 are securely fixed to the base 12 and disposed at one side by the rectangular hole punching unit 11, which is operated by an operating handle 10. The upright end plates 20 are symmetrical, each having an elongated guide slot 21 and an elongated locating slot 22 substantially disposed at right angles. A guide plate 23 is securely connected between the end plates 20, having a plurality of circular through holes 231 spaced from one another at a predetermined pitch. A hollow sliding bar 24 is provided having two opposite ends inserted into the elongated guide slots 21 on the end plates 20. A plurality of circular punching elements 25 are respectively perpendicularly fastened to the sliding bar 24 at locations corresponding to the circular through holes 231 on the guide plate 23. A plurality of locating frames 26 are respectively fixed to the guide plate 23, having a respective circular guide hole 261 respectively aligned with the circular through holes 231 on the guide plate 23. When the sliding bar 24 is installed, the circular punching elements 25 are respectively inserted into the circular guide holes 261 on the locating frames 26. A plurality of angle plates 27 are securely fixed to the guide plate 23 at suitable locations. A plurality of springs 28 are provided, each having one end secured to one angle plate 27 and an opposite end fixed to the sliding bar 24. The springs 28 support the sliding bar 24 in the upper limit position.

Figure 5:
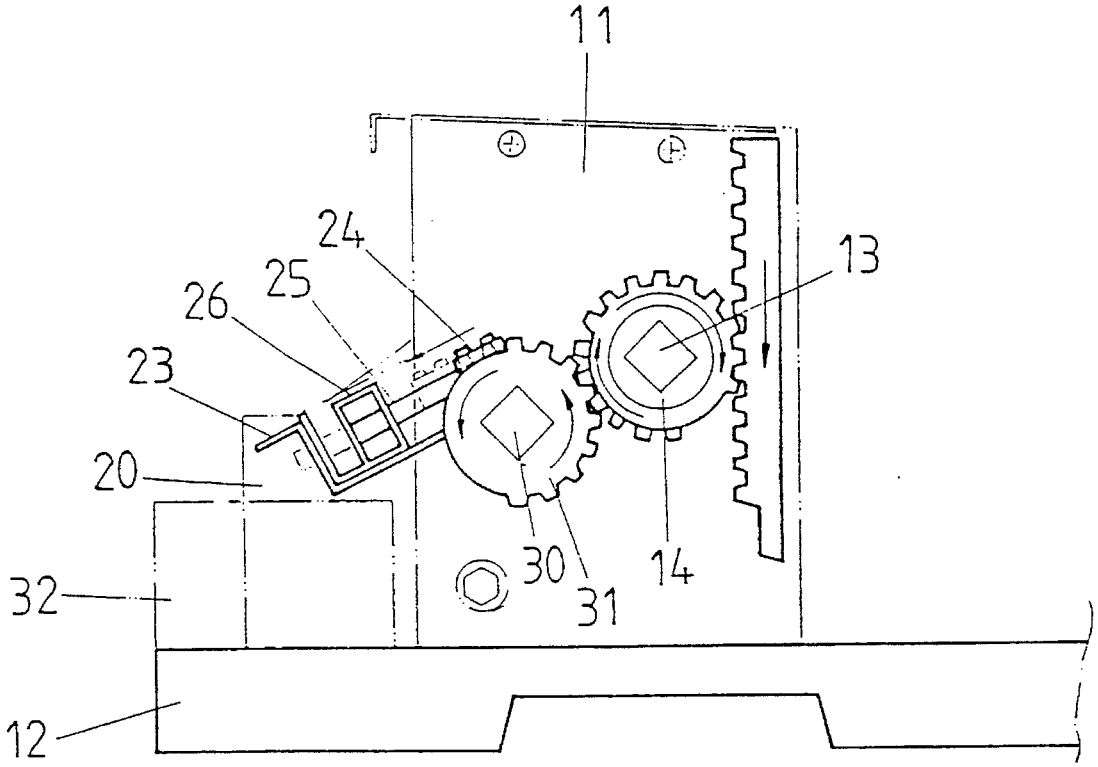
FIG. 5 is a side view in plain of the circular hole punching mechanism shown in FIG. 3, showing the linear movement of the sliding bar relative to the rotary motion of the driven gears.
Figure 6:
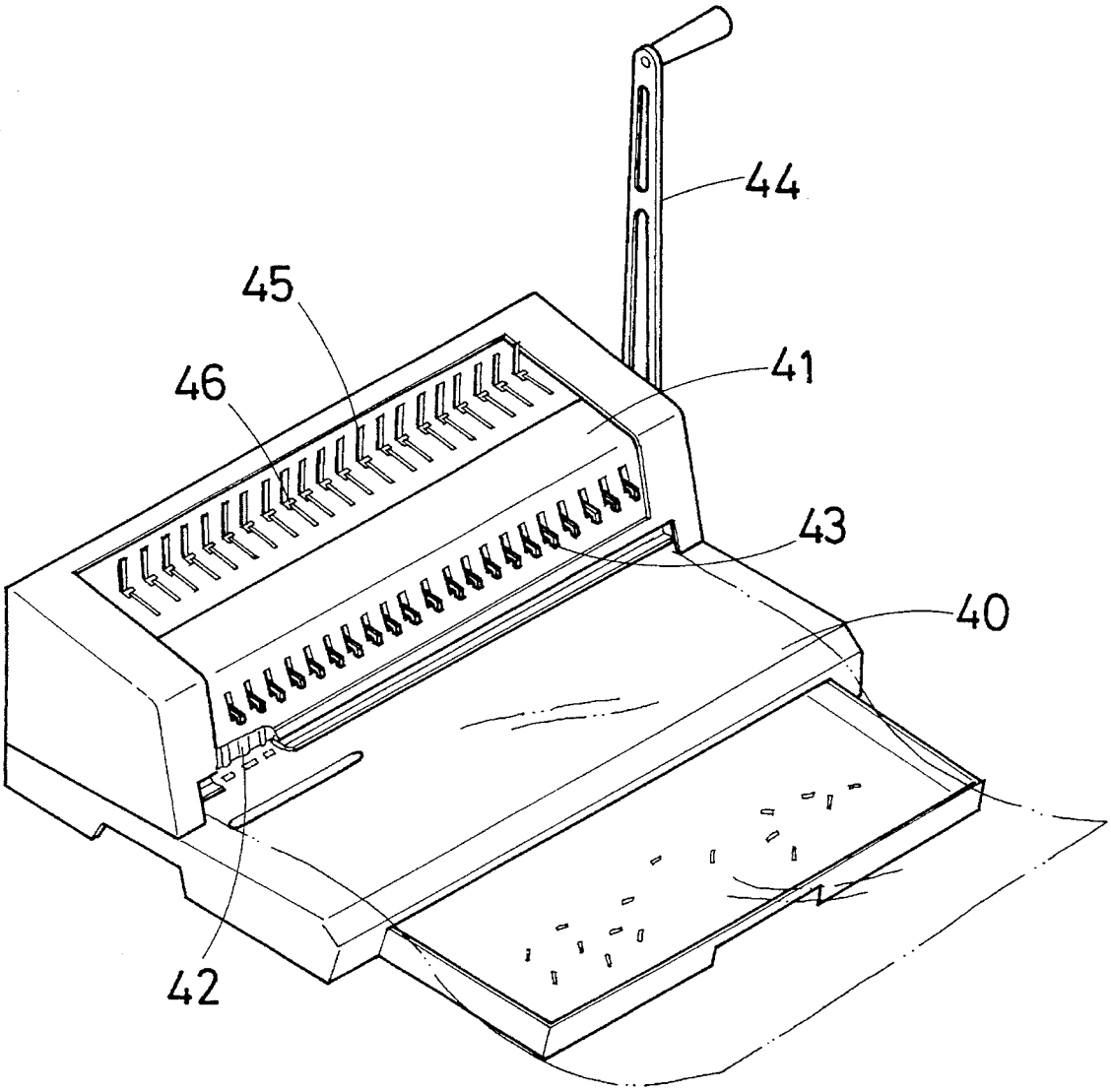
PRIOR ART FIG . 6
FIG. 6 is a perspective view of a card punch according to the prior art.
Figure 7:
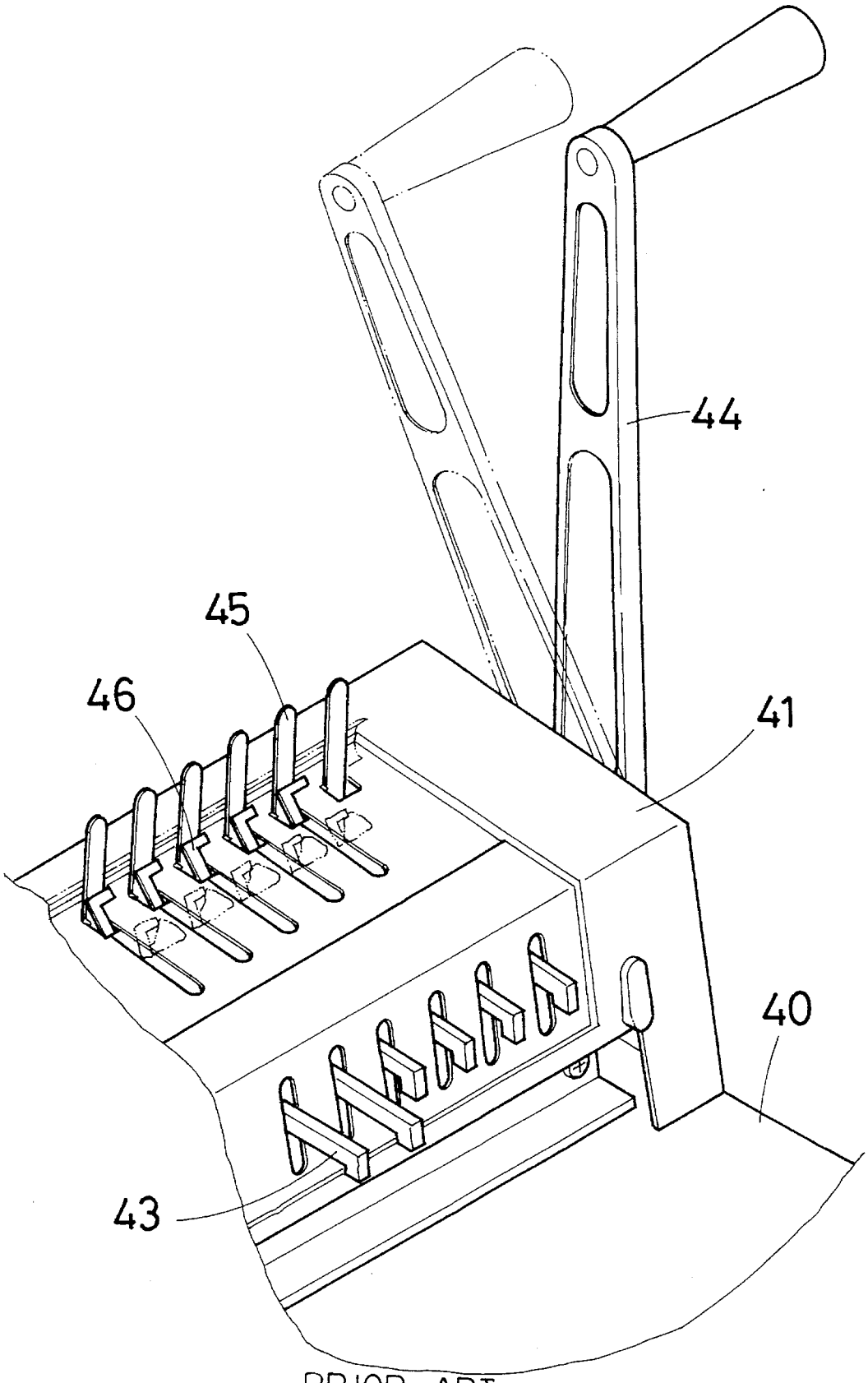
PRIOR ART FIG. 7
FIG. 7 is a partial view in an enlarged scale of FIG. 6.
Figure 8:
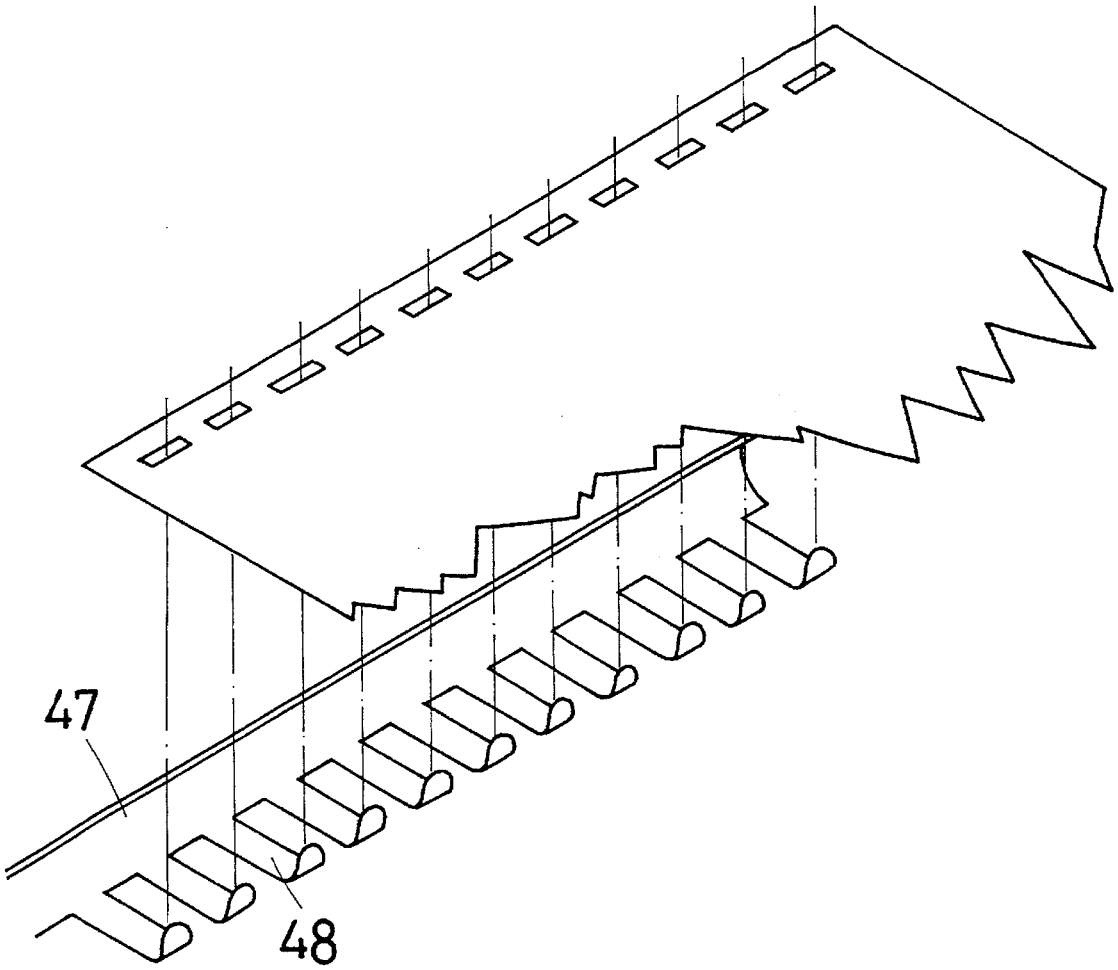
PRIOR ART FIG . 8
FIG. 8 shows the positioning of a punched card on a loose-leaf paper clip.

Referring to FIG. 5 and FIG. 3 again, two square shafts 30 are respectively revolvably mounted on the end plates 20 to hold a respective driven gear 31. The driven gear 31 is securely mounted around one square shaft 30 and meshed with a respective drive gear 14 at one end of the transmission shaft 13 of the oblong hole punching and binding unit 11. When the transmission shaft 13 is rotated by the operating handle 10, the drive gears 14 at the two opposite ends of the transmission shaft 13 are simultaneously rotated to turn the driven gears 31, causing the sliding bar 24 to move downwards along the elongated guide slots 21 on the end plates 20. On the contrary, when the transmission shaft 13 is returned to its former position, the drive gears 14 are driven to turn the driven gears 31 in the reversed direction, causing the sliding bar 24 moved upwards along the elongated guide slots 21 on the end plates 20. During the down stroke of the sliding bar 24, the punching elements 25 are forced into the circular guide holes 261 on the locating frames 26 and the circular through holes 231 on the guide plate 23, and therefore the sheets of paper which are inserted into the locating frames 26 are punched. Furthermore, there is provided a cover shell 33 covered over the aforesaid circular hole punching mechanism and the rectangular hole punching unit 11, and a tray 32 disposed below the guide plate 23 to collect paper chips.

Referring to FIG. 3 again, the circular punching keys 25 and the locating frames 26 may be respectively disconnected from the sliding bar 24 and the guide plate 23 and then secured to the sliding bar 24 and the guide plate 23 at desired locations to change the pitches among the circular punching elements 25.

Referring to FIGS. 1, 2, and 3 again, a sheet guide 35 is made on the cover shell 33 at the top for guiding the paper to be punched into a paper slot 34, which guides the paper to be punched to the locating frames 26 for punching. The sheet guide 35 has paper guides 36, which enable straight paper loading.

While only one embodiment of the present invention has been shown and described, it will be understood that various modifications and changes could be made without departing from the spirit and scope of the invention.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I'claim:

1. A card punch comprising a base, an operating handle, a rectangular hole punching unit mounted on said base and driven by said operating handle to punch paper, said rectangular hole punching unit comprising a transmission shaft coupled to said operating handle, a series of rectangular punching elements, and a plurality of links connected between said rectangular punching elements and said transmission shaft, and a circular hole punching mechanism, and a cover shell covered over said circular hole punching mechanism and said rectangular hole punching unit, wherein said circular hole punching mechanism comprises:

two drive gears fixedly mounted around two opposite ends of said transmission shaft;

two upright end plates securely fixed to said base, each upright end plate having a respective elongated guide slot and an elongated locating slot;

two square shafts revolvably mounted on said upright end plates;

two driven gears securely mounted around said square shafts and meshed with said drive gears;

a guide plate securely connected between said end plates, having a plurality of circular through holes spaced from one another at a predetermined pitch;

a plurality of locating frames respectively fixed to said guide plate, each frame having a circular guide hole aligned with one of the circular through holes in said guide plate;

a hollow sliding bar having two opposite ends inserted into the elongated guide slots on said end plates, said sliding bar being moved up and down along the elongated guide slots on said end plates by said driven gears when said transmission shaft is driven by said operating handle to turn said drive gears; and a plurality of circular punching elements respectively perpendicularly fastened to said sliding bar and respectively inserted into the circular guide holes on said locating frames and driven by said sliding bar to punch paper being inserted into said locating frames.

2. The card punch of claim 1 wherein said cover shell comprises a sheet guide and a paper slot for guiding paper into said locating frames for punching.

3. The card punch of claim 2 wherein said sheet guide has two paper guides, which enable straight paper loading.

4. The card punch of claim 1 wherein said circular hole punching mechanism further comprises a plurality of angle plates securely fixed to said guide plate and a plurality of springs connected between said angle plates and said sliding bar.

5. The card punch of claim 1 wherein said sliding bar has a series of mounting holes corresponding to the circular through holes on said guide plate for mounting said circular punching keys.

6. The card punch of claim 1 further comprising a tray received in said cover shell below said guide plate for collecting paper chips.

* * * * *